US006241180B1

(12) United States Patent
Potter

(10) Patent No.: US 6,241,180 B1
(45) Date of Patent: Jun. 5, 2001

(54) APPARATUS FOR HOLDING AND DISPENSING ROLLED SHEET MATERIAL

(76) Inventor: David S. Potter, 877 Lilac Dr., Santa Barbara, CA (US) 93108

( * ) Notice: Subject to any disclaimer, the term of this patent is extended or adjusted under 35 U.S.C. 154(b) by 0 days.

(21) Appl. No.: 09/333,774

(22) Filed: Jun. 15, 1999

(51) Int. Cl.[7] ..... B65H 75/24; B65H 16/06

(52) U.S. Cl. ..... 242/571.5; 242/598.5; 242/599.3; 242/599.4

(58) Field of Search ..... 242/571.5, 598.3, 242/598.5, 599.3, 599.4

(56) References Cited

U.S. PATENT DOCUMENTS

| | | | |
|---|---|---|---|
| 609,228 | 8/1898 | Clarke . | |
| 777,981 | 12/1904 | Sterling . | |
| 805,011 | 11/1905 | Gomber . | |
| 1,202,190 | 10/1916 | Kern . | |
| 1,455,195 | 5/1923 | Foothorap . | |
| 1,674,285 | 6/1928 | Harvey . | |
| 1,973,354 | 9/1934 | Nedberg . | |
| 2,248,716 * | 7/1941 | Markle, Jr. | 242/598.3 |
| 2,650,773 | 9/1953 | Fanning . | |
| 3,165,772 | 1/1965 | McGinley . | |
| 3,386,673 | 6/1968 | Mader . | |
| 3,467,330 | 9/1969 | Yavitch . | |
| 3,788,573 | 1/1974 | Thomson et al. | 242/55.2 |
| 4,071,200 | 1/1978 | Stone | 242/55.2 |
| 4,239,163 | 12/1980 | Christian | 242/55.2 |
| 4,483,491 | 11/1984 | Rainey | 242/55.2 |
| 4,913,365 | 4/1990 | Shamass | 242/55.2 |
| 5,060,882 * | 10/1991 | Ronsculp et al. | 242/598.3 |
| 5,549,218 | 8/1996 | Asmussen | 221/282 |
| 5,570,564 | 11/1996 | Moore et al. | 53/389.2 |

FOREIGN PATENT DOCUMENTS

| | | |
|---|---|---|
| 157939 | 1/1905 | (DE) . |

* cited by examiner

*Primary Examiner*—John Q. Nguyen
(74) *Attorney, Agent, or Firm*—Fulbright & Jaworski, LLP

(57) ABSTRACT

A rolled sheet material dispenser and holder that allows one to tear off a single sheet at a time without unrolling unwanted sheets. The apparatus is designed so that the moment of inertia of the core element and paper roll are sufficient to retard excessive spooling when a sheet is torn off the roll.

12 Claims, 2 Drawing Sheets

APPARATUS FOR HOLDING AND DISPENSING ROLLED SHEET MATERIAL

BACKGROUND OF THE INVENTION

1. Field of the Invention

The present invention relates generally to the field of rolled sheet materials, primarily those having individual sheets separated by perforation. More particularly, it concerns an apparatus for holding and dispensing paper towels or toilet paper.

2. Description of Related Art

It is desirable to have a holder and dispenser for rolled sheet materials such as paper towels, toilet paper and the like, in which a roll of sheet material may be pulled down easily to expose a sheet of material, and yet, a single sheet can be torn from the roll with the use of just one hand. Further, it is desirable to tear a single sheet of material without causing unwanted unrolling or free-spooling of additional sheets.

Previous holders and dispensers have largely been unsuccessful in this regard because they often lead to only partial separation of a sheet, or at the other extreme, excessive free spooling of additional sheets. Traditional holder and dispensers often rely upon frictional forces only to control tearing parameters. With traditional devices, a frictional force is applied at a fixed radius, generating a fixed frictional torque that resists a tearing force. On the other hand, tearing forces occur at an outer radius of a paper roll, generating a tearing torque that varies directly with the diameter of the roll of paper at the tear point.

Also retarding the unrolling of paper is the moment of inertia of the rolled sheet material itself. As the roll becomes thinner, this moment of inertia decreases. Traditional holder and dispensers often suffer from the familiar problem of unwanted spooling of extra sheets of paper when the roll is almost empty, particularly when the amount of paper remaining approaches a third to a half of a full roll. Traditional holder and dispensers also suffer from the familiar problem of tearing only a small portion of a sheet, rather than an entire perforated sheet, when a roll of paper is almost full.

Problems pointed out in the foregoing are not intended to be exhaustive but rather are among many that tend to impair the effectiveness of previously known holders and dispensers of rolled sheet material. Other noteworthy problems may also exist; however, those presented above should be sufficient to demonstrate that previous techniques appearing the art have not been altogether satisfactory, particularly in providing for tearing of complete sheets from a roll without unwanted spooling.

SUMMARY OF THE INVENTION

In one respect, the invention is an apparatus for holding and dispensing sheet material from a roll. The apparatus includes a core element and a frame. The core element is configured to support the roll. The core element includes a rod and a plurality of spring members. The spring members are coupled to the rod and extend in arcuate conformation along at least a portion of the rod. The frame is configured to support the core element. The frame includes a pair of opposing side members and opposing grooves. Each of the side members has a front edge and a facing side. The opposing grooves are defined within the facing sides and are contiguous with the front edges. The opposing grooves are configured to cooperatively receive the rod. The grooves define a wedge configured to pinchingly engage the rod to increase a friction force between the rod and the grooves upon rotation of the rod. The core element has a moment of inertia complementing the friction force to retard rotation of the roll and to facilitate tearing of the sheet material from the roll.

In other aspects, the sheet material may include paper towels. The sheet material may include toilet paper. The apparatus may also include a pair of end bells coupled to the rod and arranged in spaced relation. The end bells may include one or more segments. The plurality of spring members may be secured between the segments. At least a portion of an outer surface of the rod may include a material having a gripping coefficient of friction greater than that of a material comprising the bulk of the rod. The rod may include metal. The rod may include plastic. The rod may include wood. The rod may be hollow.

In another respect, the invention is an apparatus for holding and dispensing sheet material from a roll. The apparatus includes a core element and a frame. The core element is configured to support the roll. The core element includes a rod, a pair of end bells, and a plurality of spring members. The pair of end bells are coupled to the rod and arranged in spaced relation. The plurality of spring members are coupled to the pair of end bells and extend in arcuate conformation along at least a portion of the rod. The frame is configured to support the core element. The frame includes a base; a pair of opposing, generally parallel side members; and opposing grooves. The pair of opposing, generally parallel side members are coupled to the base, and each of the side members has a front edge and a facing side. The opposing grooves are defined within the facing sides and are contiguous with the front edges. The opposing grooves are configured to cooperatively receive the rod. The grooves define a wedge having a first acute angle, and the wedge is configured to pinchingly engage the rod to increase a friction force between the rod and the grooves upon rotation of the rod. The grooves define a second acute angle with respect to the front edges. The core element has a moment of inertia complementing the friction force to retard rotation of the roll and to facilitate tearing of the sheet material from the roll.

In other aspects, the rod may be heavier than the end bells. The weight of the rod may be concentrated at an outer radius of the rod. At least a portion of an outer surface of the rod may include a material having a gripping coefficient of friction greater than that of a material comprising the bulk of the rod. The first acute angle may be about 30 degrees. The second acute angle may be about 45 degrees.

In another respect, the invention is an apparatus for holding and dispensing sheet material from a roll. The apparatus includes a core element and a frame. The core element is configured to support the roll and includes a rod, a pair of end bells, and a plurality of spring members. The pair of end bells is coupled to the rod and arranged in spaced relation. The plurality of spring members are coupled to the pair of end bells and extend in arcuate conformation along at least a portion of the rod. The frame is configured to support the core element and includes a base; a pair of opposing, generally parallel side members; and opposing grooves. The pair of opposing, generally parallel side members are coupled to the base, and each of the side members has a front edge and a facing side. The opposing grooves are defined within the facing sides and are contiguous with the front edges. The opposing grooves are configured to cooperatively receive the rod. The grooves define a wedge having an angle of about 30 degrees, and the wedge is configured to pinchingly engage the rod to increase a friction force between the rod and the grooves upon rotation of the rod. The grooves define an angle of about 45 degrees with respect to the front edges. The core element has a moment of inertia complementing the friction force to retard rotation of the roll and to facilitate tearing of the sheet material from the roll.

Other features and advantages of the disclosed method and apparatus will become apparent with reference to the following detailed description of embodiments thereof in connection with the accompanying drawings wherein like reference numerals have been applied to like elements, in which:

DESCRIPTION OF ILLUSTRATIVE EMBODIMENTS

It will be appreciated that the presently disclosed apparatus provides for certain significant advantages. For instance, the apparatus allows a single sheet of material to be torn, with one hand, from a roll without holding the roll and without spooling off extra sheets while still allowing one to easily pull down a subsequent sheet when desired. The apparatus achieves this, in part, by providing an inertial force arising from a core supporting the rolled sheet material that acts in conjunction with a frictional force arising from rotation of that core. The presently disclosed apparatus may be utilized for holding and dispensing many different types of rolled sheet material including paper towels and toilet paper.

Figure 1:
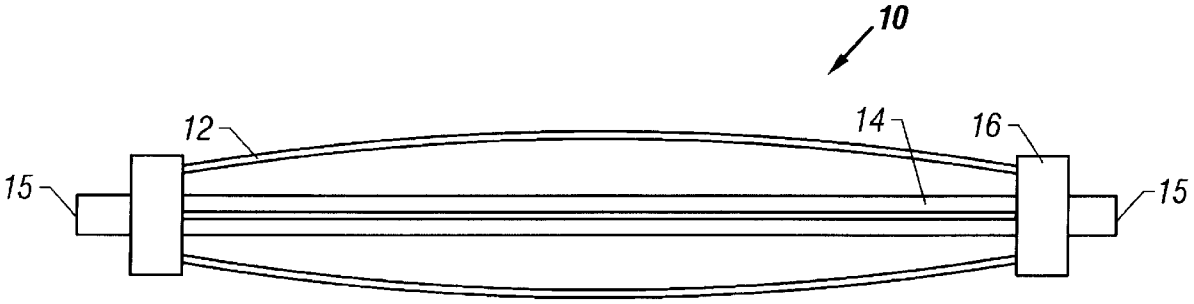
FIG.1is a side view of a core element including a rod that is generally heavier than the end bells.
Figure 2:
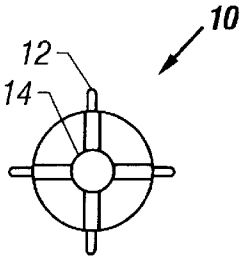
FIG. 2 is an end view of a core element showing an end bell that is generally lighter than the rod.
Figure 3:
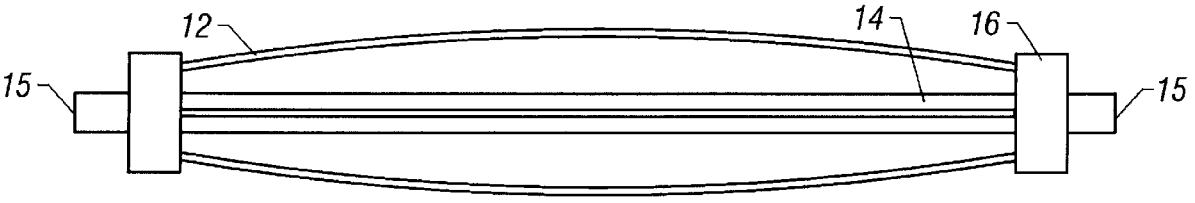
FIG. 3 is a side view of a core element including a rod that is generally lighter than the end bells.
Figure 4:
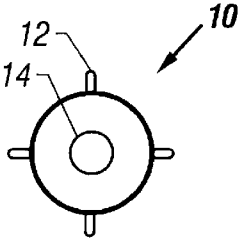
FIG. 4 is an end view of a core element showing an end bell that is generally heavier than the rod.
Figure 5:
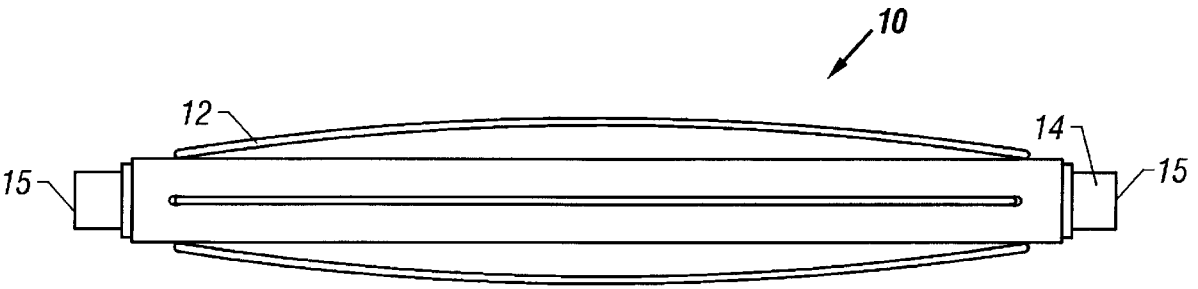
FIG. 5 is a side view of a core element including a hollow rod.

FIGS. 1–6 show various core elements adapted to support a roll of sheet material according to various embodiments. FIG. 7 shows a frame 20 adapted to support the various core elements of FIGS. 1–6. Each of FIGS. 1–6 show a core element 10 having a rod 14 with ends 15, a pair of end bells 16, and a plurality of spring members 12. In the embodiment of FIG. 1, rod 14, including ends 15, is solid and is made from steel. In the embodiment of FIG. 3, rod 14, including ends 15, is solid and is made from wood. In the embodiment of FIG. 5, rod 14 is hollow and made from metal, and ends 15 are solid and made from wood. With the benefit of the present disclosure, those of skill in the art will recognize that rods 14 may be made from any suitable material including, but not limited to, plastic, copper, brass, aluminum, titanium, graphite, nickel, molybdenum, metal alloys, or combinations thereof. Lengths of rods 14 may vary according to the application. In particular, if rods 14 are designed for use with paper towels, they may have a length of about 12.5 inches. If rods 14 are designed for use with toilet paper, they may have a length of about 5.75 inches. In the illustrated embodiments, each rod 14 has a length of about 12.5 inches.

Coupled adjacent ends 15 of rods 14 of FIGS. 1 and 3 are end bells 16 arranged in spaced relation. The spacing of end bells 16 may vary according to application, and more specifically, may be spaced so that end bells 16 support opposite ends of a roll of sheet material. For paper towel applications, (the illustrated embodiment), they may be spaced about 9.75 inches (with a distance of about 11.25 between outside edges), while for toilet paper they may be spaced about 4 inches apart. In the embodiment of FIG. 1, end bells 16 are made of wood. In the embodiment of FIG. 3, end bells 16 are made of steel. Their diameters may vary according to the application. For instance, for paper towel applications (the illustrated embodiment), end bells 16 may have a diameter of about 1.5 inches. For toilet paper applications, end bells 16 may have a diameter of about 1.5 inches.

Outer surfaces of ends 15 may be configured to slide into opposing grooves 22 of FIG. 7. Between the outer surface of ends 15 and the inner surface of the roll may exist frictional forces characterized by a gripping coefficient of friction. The frictional forces allow, in part, ends 15 to firmly engage opposing grooves 22 to produce desirable tearing characteristics. By modifying those frictional forces, one may modify certain tearing characteristics. In one embodiment, the outer surface of ends 15 may be covered with a material that exhibits a gripping coefficient of friction greater than that of a material making up the rest of ends 15. Likewise, ends 15 may be surface treated to influence their gripping coefficient of friction. For instance, an outer surface of ends 15 may be pitted or roughened to achieve a desired gripping coefficient.

Each of FIGS. 1–6 show spring members 12 coupled to rod 14. Spring members 12 may be configured to secure a roll of sheet material about rod 14. In the illustrated embodiments, spring members 12 extend in arcuate conformation along most of rod 14. The arc shape provides for an outward-directed force upon deflection of spring members 14—that force aids in securing a roll of sheet material about rod 14.

In the illustrated embodiments, spring members 12 are steel, and more particularly, 0.71 inch diameter "music" wire. However, it is contemplated that any other suitable material of a suitable size may be substituted therewith. In order to give a large elastic deformation and, therefore, a large deflection capability, spring members 12 may be pre-stressed to form a desired arc. Following pre-stressing, the central arc of the spring members may have a radius of curvature, in one embodiment, of about 9 inches.

Spring members 12 may be designed to make a wire arc just critical for a specific tube diameter, such as a diameter of about 1.6 inches for paper towel rolls. That is, for some diameter less than about 1.6 inches, the stress on a spring member may exceed an elastic limit and there may be a slight deformation that will decrease the curvature and just allow the new diameter to be accommodated. This may be termed a self adjusting property for undersized tubes.

In one embodiment, spring members 12 may be formed in the following way. They may first be cut to length and the end configuration (e.g., a hook to capture the wire in the end bell or in a hollow rod) may be formed. The spring member may then be formed into an arc by forcing it around a circular form of appropriate radius. In one embodiment, this radius may be about 2 inches. This gives a final arc having about a 7 inch radius. A final desired radius of about 9 inches may be achieved by flattening the wire in a suitable fixture. This prestressing creates a spring member which, when in use, may be flattened without overstressing and deforming the shape, and maintains a high spring constant of force to deflection ratio. The mounting arrangement for the spring members and the length of the spring members may be adjusted to provide tension on the spring members when a roll of paper is absent. In one embodiment, the tension should bring the maximum distance of the arc from the centerline of the core to about 1.25 inches.

FIGS. 2 and 4 illustrate end bells 16, rods 14, and spring members 12 of the embodiments of FIGS. 1 and 3, respectively. As illustrated, at least one end of end bell 16 may be segmented. In the illustrated embodiment of FIG. 2, an end of end bell 16 has four segments (one of which is labeled segment 17). In between segments 17 may be a gap 18. In the illustrated embodiment, spring members 12 may be coupled to core 10 and rod 14 in between segments 17, within gaps 18. In one embodiment, the coupling may be accomplished by forming a hook at ends of spring members 12 and by inserting those hooks securedly into gaps 18. In the embodiment of FIG. 4, it may be seen that an end of an end bell 16 may be solid, as shown. In this embodiment, spring members 12 may be coupled to core 10 and rod 14 in a manner similar to the technique of FIG. 2. In particular, ends of spring members 12 may be hooked and may be inserted securedly into gaps 18 (not shown in FIG. 4) that may be present on the backside of the illustrated end bell 16 of FIG. 4. With the benefit of the present disclosure, however, it will be understood that any number of suitable methods known in the art may be used to couple spring members 12 to core 10 and rod 14. For example, it is contemplated that one may use bolts or any other device suitable to couple materials.

Figure 6:
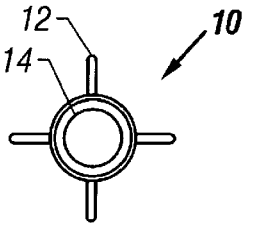
FIG. 6 is an end view of a core element showing placement of wire ends in a hollow rod.
Figure 7:
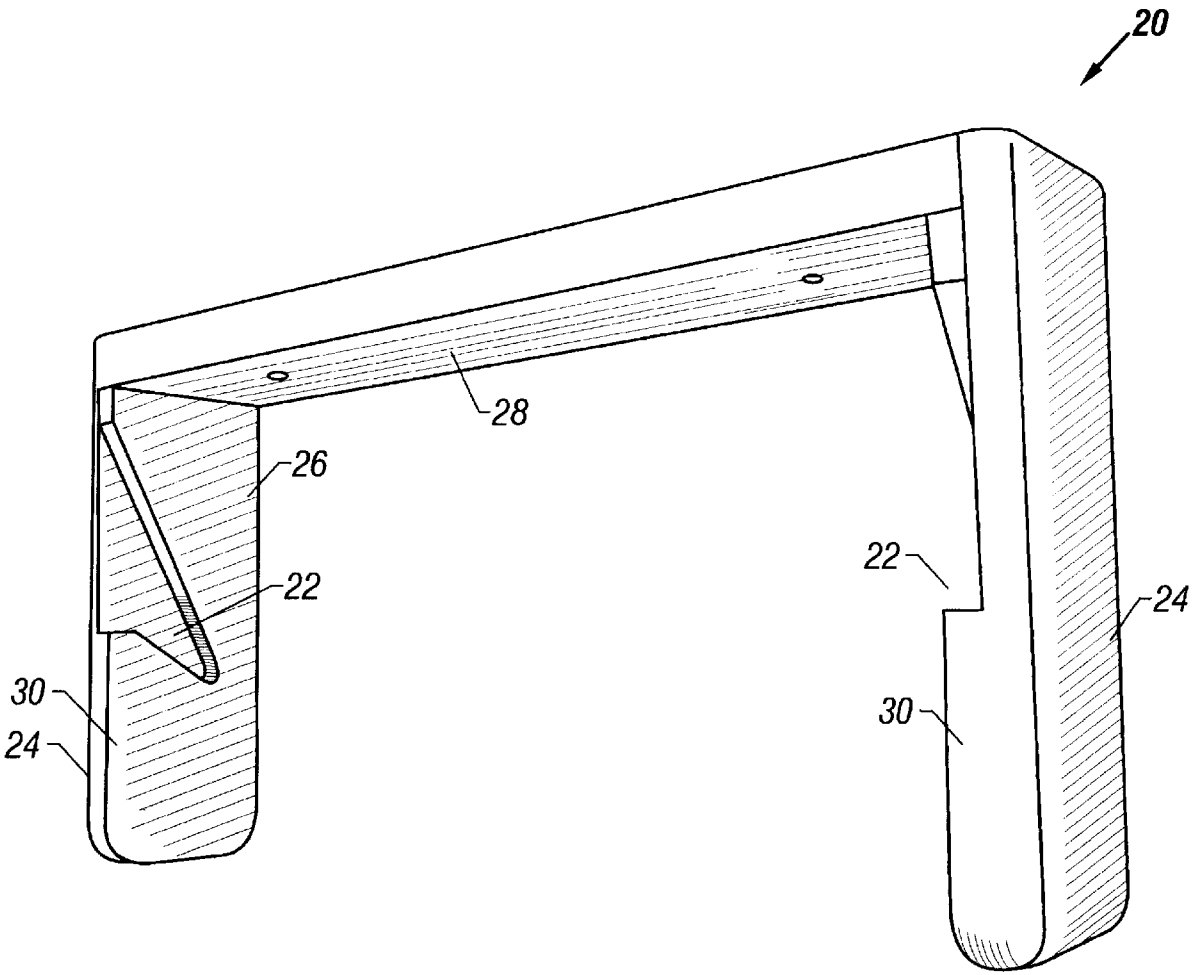
FIG. 7 is a side view of a frame.

The embodiment of FIG. 6 shows that end bells 16 may be absent from core 10. In this embodiment, spring members 12 may be coupled to core 10 and rod 14 by coupling directly to rod 14. In one embodiment, ends of spring members 12 may be hooked and may be inserted into hollow rod 14. However, it will be understood that numerous other techniques known in the art may be used to couple the spring members 12.

In the embodiments of FIGS. 2, 4, and 6, there is shown four spring members 12 evenly spaced around a rod 14 to provide equal tension on a, typically, cardboard tube or roll on which the sheet material is rolled. It is to be understood, however, that one may use any number of spring members 12 that are evenly spread about rod 14.

In the embodiments of FIGS. 1 and 2, end bells 16 are lighter than rod 14, while in the embodiments of FIGS. 3 and 4, end bells 16 are heavier than rod 14. In the embodiments of FIGS. 5 and 6, there are no end bells. However, since rod 14 is hollow, its weight is concentrated at its maximum radius. The parameters of these embodiments may all be designed to advantageously affect the moment of inertia of core 10. More specifically, the illustrated designs, particularly including the distribution of weights described above and the arrangement of components illustrated, advantageously provide for an inertial force additional to, and complementary with, frictional forces of rotation that sufficiently retard rotation of a roll of sheet material to allow for precise tearing of a single sheet of material without excessive unspooling while still allowing a single, subsequent sheet to be easily advanced.

Turning now to FIG. 7, there is shown a frame 20 including a base 28, side members 24, facing sides 26, front edges 30, and opposing grooves 22. In one embodiment, frame 20 may be made from wood, but any other suitable material such as metal, marble, ceramic, acrylic, or synthetic material heavy enough to support the core element may be substituted therewith. Frame 20 may be attached to a surface such as a wall or under a cabinet such that the side members 24 project in a downward (under cabinet) or in a forward (wall) direction. In certain embodiments, holes may be drilled through base 28 for mounting purposes.

As illustrated, side members 24 may be generally parallel and may be coupled to base 28 to form a generally U-shaped device. Side members 28 may be coupled to base 28 by any technique known in the art, such as, for instance, by nails, glue, screws, or the like. Opposing grooves 22 may be defined within facing sides 26, in direct opposing relationship. Opposing grooves 22 may be contiguous with front edges 30, as shown. Opposing grooves may be formed in any manner known in the art. For instance, opposing grooves 22 may be formed with a router. In the illustrated embodiment, opposing grooves 22 form a wedge. Acute angle 25, characterizing the wedge, may vary widely, but in one embodiment, angle 25 may be about 30 degrees. As illustrated, opposing grooves 22 also form another acute angle 27 with respect to front edges 30. Angle 27 may vary widely, but in one embodiment, angle 27 may be about 45 degrees.

Opposing grooves 22 may be configured to cooperatively receive ends 15 of rods 14. In operation, a core 10 sits within frame 20, with ends 15 of rod 14 sitting within the wedge defined by opposing grooves 22. In the illustrated embodiments, the wedge of opposing grooves 22 may pinchingly engage ends 15 of rod 14. Specifically, opposing grooves 22 may maintain at least two contact points within the grooves. The pinching action of the wedge of opposing grooves 22 may provide an increase friction force between ends 15 and opposing grooves 22 upon rotation of cylindrical ends 15 of rod 14. This increased frictional force may act in conjunction with the inertial force characterized by the moment of inertia of core 10 to advantageously allow for desirable tearing characteristics of sheet material from a roll supported by core 10. More specifically, the moment of inertia of core 10 may complement a frictional force to produce desired tearing results.

The following example are included to demonstrate different embodiments of the present disclosure. It should be appreciated by those of skill in the art that the techniques disclosed in the example that follows represent techniques discovered by the inventor to function well in the practice of the invention. However, those of skill in the art should, in light of the present disclosure, appreciate that many changes can be made in the specific embodiments which are disclosed and still obtain a like or similar result without departing from the spirit and scope of the invention.

EXAMPLE 1

The core 10 may contains three elements worthy of further mention and analysis: (i) the inertial element, (ii) the friction element that in conjunction with the frame provides a retarding force to prevent "free spooling," and (iii) the spring assembly that serves to "lock" the cardboard or other such tube that holds the sheet material being held and dispensed. The spring assembly may include at least two elements: (i) the spring members, and (ii) end bells that maintain spring orientation with respect to the axis of the core 10. As mentioned earlier, spring members may be mounted directly into a rod or may be fastened to end bells.

General

There are three phrases to tearing off a sheet of paper, each phase having its own critical elements. In the first or preliminary phase of pulling one sheet of paper off the roller to ready it for being torn off, the "pull" force must be less than that required for tearing the sheet at the perforation. The torque produced by "pulling" is the product of the force times the radius of the remaining paper and is a minimum for the last few sheets. This torque, however, must be larger than the static retarding torque of friction caused by the weight of the core and the force to pull the sheet of paper out. The second phase, or "tearing" phase, is initiated by a quick pulling action, generally parallel to the paper roll, and features a pulling force considerably greater than that necessary to start the "tear" at the perforation. The roll of paper now begins to rotate, and although the friction can reduce the amount of roll, it is the inertial element that provides the retarding force to limit the total rotation. The third or "stopping" phase is to dissipate the stored energy of the rotation and hence stop the rotation. It is important to optimize the contributions of inertia and friction to limit the total amount of paper which is rolled off in phases two and three, and this is best done by use of the embodiments discussed herein.

The Friction Element

The frictional element may be provided by the end bells or the core rotating in the grooves of the frame. The grooves may be arranged in a wedge shape so that the rotation is supported by both sides of the grooves. This arrangement provides for a pinching action and multiplies the friction force by a geometrical coefficient. If the sum of all forces acting on the core is directed at an angle theta with respect to the axis of the wedge, and if the wedge has a half-angle alpha, then the geometric multiplier is given by cosine theta divided by sine alpha. In one embodiment the angle theta may be about 45 degrees and the half angle of the wedge may be about 15 degrees. This gives a multiplier of approximately 2.7 for either a vertical force (gravity) or the horizontal "pull" force. For the actual coefficient of friction used in the embodiments discussed here of approximately 0.25, the sum of the tangential forces acting on the wedges due to gravity is about 0.86 times the weight of the core plus paper. This multiplication is of immense value in providing sufficient friction for good operation.

The Inertial Element

It should be noted that in embodiments utilizing a solid cylinder, one embodiment places the weight in the form of a heavy central cylinder or rod, with the end bells being generally lighter. In other embodiments, the weight may be concentrated in the end bells, with the central rod being generally lighter than in embodiments when the rod or cylinder is heavier. The embodiments disclosed herein each use different inertial elements that allow the use of assemblies that are heavier and concentrated at small radii, and lighter assemblies that allow a smaller amount of weight to be concentrated at the larger radii. The skilled artisan will recognize that the choice between friction and inertia is broad, yet given the teachings of the present specification such design parameters may be optimized for a given application.

The Frictional Force

There are several ways in which frictional forces can be brought into play in the embodiments described herein. If a roll of paper is coupled to the core, the two can be considered as one unit. The weight of the core plus paper then gives a vertical force acting between the core and the holder. The core ends may be cylindrical and mount in the holder in slots. If slots are larger than the core radius, then there will be a single point of contact between the core and the holder slot at each end. The frictional torque is the product of the weight of the core plus paper, times the radius of the core, times the coefficient of friction between the core element and the holder. During the tearing cycle, the force exerted to tear the paper is generally horizontal and thus the force producing the friction is the vector sum of the horizontal and vertical forces. If the slot is wedge-shaped so that the core has two points of contact with the slot sides, then the coefficient of friction is multiplied by a geometrical factor (the "pinch" action) which takes into account both the wedge angle and the orientation of the wedge to the force. As a result of these considerations, one has a great deal of latitude in designing the frictional elements.

Attachment of the Paper Roll to the Core

In the previous section it was assumed that the paper roll and the core were locked together. There is an upper bound to the force that can be applied to "lock" the roll to the core. Not only can an inner cardboard tube that the paper is wrapped on be damaged, but in the extreme, it can be pushed out of the paper. The lower bound can be established by a consideration of the tear force at the minimum diameter which need only be as great as the force necessary to tear the paper. When this level is achieved, the tearing relieves the pulling force, at about 1½ pounds. For larger radii, the inertial forces of the paper come into play and become the major retarding force. Thus, the least force required is that necessary to"lock" the roll to the core at the minimum radius, or about 1½ pounds. The coefficient of friction, cardboard holder to wire springs, is about 0.3 . Hence, the total spring force may be about 5 pounds. The inner diameter of the cardboard tube varies with the manufacturer and may go from a low of about 1.5 inches to a maximum of about 1.75 inches. Ideally, the force shouldn't change much over the span of distances. If the spring rate is constant (force vs. compression is linear) and one allows the least force at about 1.75 inches to be about ¾ of the maximum force at 1.5 inches, then the zero-force (starting point) must be at 2½ inches diameter. Assuming several spring members equally spaced around the periphery, then the radius may go from 1¼ inch to ¾ inch for a total linear region of ½ inch and the total number of spring members adjusted to provide the total required force.

How the Paper Tears

The mechanism of tearing was investigated by using a cam-corder running at 60 frames per second to photograph tearing action. The sequence of events was as follows. The initial pull on the paper, (directed across the face of the paper) took up the slack and began to put a tension on the paper, distributing the force of the pull along several inches of the perforation. The acceleration to a final hand velocity that the operator deems sufficient was rapid and essentially completed by this time. When the force on the paper was sufficient to overcome the frictional forces the roll began to turn, the rotation being restrained by both the frictional drag forces and the moment of inertia of the assembly. During this phase, the paper stretched and if the hand velocity of the operator was sufficiently high, the paper tore at the perforation. If the velocity was too low the rotation rate had time to increase and the tearing force was insufficient to start the tear and the paper simply unrolled. After the leading edge perforation broke there followed an uncontrolled separation of several inches of the perforations. The favorable tear geometry described herein permitted the completion of the tear with very little effort.

The hand velocity may vary quite widely. A"lazy" pull achieving a terminal velocity between 20 and 30 inches per second generally resulted in a"no tear" test. From 30 to 40 inches per, second was usually successful when the roll was full, and with the embodiments disclosed herein, succeeded when the roll was almost used up. Velocities of forty inches per second were easy to achieve and always succeeded across the entire range of roll use. It is possible to get much higher velocities but the tearing has already been achieved before the highest velocity can be reached.

A Simplified Model

To investigate the various possible geometries and the effects of varying frictional and inertial forces, it was necessary to develop a simplified model of the process of tearing the paper. The model made no assumption about the hand velocities during the first phase of the pull where the"slack" is being taken up and the force finally becomes large enough to overcome the frictional retarding force. During the second or"tearing" phase the operator's hand velocity was assumed constant, the paper stretched, and the unrolling of the paper began. As the paper stretched, the tearing force on the edge perforation increased and finally the paper tore. The stored energy in the stretched paper exceeded the tearing energy and the tear propagated at high velocity for several inches. The continued hand movement completed the task rather easily.

An engineering model for this phase may be solved in closed form under the condition of constant velocity, a condition that was essentially what was observed in the photographic sequences. In addition to the readily measurable parameters of frictional and inertial elements, one must also determine a tearing force and an effective spring rate of the paper, taking into account that the geometrical factor associated with the transverse hand motion.

The third phase was the post tear phase and was important because the major unrolling of the paper occurs in this phase. This calculation depends only upon easily measured parameters and the rotational velocity at the conclusion of the tear phase.

Given the above, the equation of motion was readily solved. The outputs of interest were:

1). The minimum velocity for any given configuration necessary to tear the paper 2). The lengths of paper unrolled with a pre-set velocity An example of such a calculation is given below in table format.

| PAPER | SPECIAL CASE: MINIMUM VELOCITY | | | GENERAL CASE: VELOCITY = 40 INCHES/SEC | |
|---|---|---|---|---|---|
| RADIUS IN INCHES | MINIMUM VELOCITY | LENGTH AT TEAR | LENGTH AFTER TEAR | LENGTH AT TEAR | LENGTH AFTER TEAR |
| 2.75 | 24.3 | 0.38 | 2.46 | 0.05 | 0.28 |
| 2.5 | 26.2 | 0.38 | 2.45 | 0.06 | 0.34 |
| 2.25 | 28.2 | 0.38 | 2.40 | 0.07 | 0.41 |
| 2 | 30.2 | 0.37 | 2.30 | 0.09 | 0.48 |
| 1.75 | 31.9 | 0.37 | 2.14 | 0.10 | 0.53 |
| 1.5 | 32.4 | 0.37 | 1.90 | 0.11 | 0.50 |
| 1.25 | 30.9 | 0.36 | 1.58 | 0.09 | 0.35 |
| 1 | 26.0 | 0.34 | 1.16 | 0.05 | 0.16 |
| 0.8 | 19.7 | 0.31 | 0.76 | 0.03 | 0.05 |

| QUANTITY | | |
|---|---|---|
| MAXIMUM RADIUS OF PAPER ROLL | 2.75 | INCH |
| MINIMUM RADIUS OF PAPER ROLL | 0.75 | INCH |
| WEIGHT OF FULL ROLL | 0.9 | POUND |

-continued

| | | |
|---|---|---|
| WEIGHT OF CORE | 0.85 | POUND |
| RADIUS OF GYRATION OF CORE | 0.55 | INCH |
| FORCE TO TEAR PAPER | 1.5 | POUND |
| EFFECTIVE SPRING CONSTANT OF PAPER | 2 | POUND/INCH |
| VELOCITY OF TEARING PULL | 40 | INCH/SEC |
| RADIUS OF APPLICATION OF WEIGHT FRICTION | 0.375 | INCH |
| COEFFICIENT OF FRICTION FOR WEIGHT | 0.25 | |
| MULTIPLIER OF WEIGHT FRICTION | 2.7 | |
| EFFECTIVE RADIUS FOR FRICTION TORQUE | 0.253 | INCH |
| RADIUS OF APPLICATION OF PULL FRICTION | 0.375 | INCH |
| COEFFICIENT OF FRICTION FOR PULL | 0.25 | |
| MULTIPLIER OF PULL FRICTION | 2.7 | |
| EFFECTIVE RADIUS FOR PULL TORQUE | 0.253 | INCH |
| INERTIA OF CORE | 0.00804 | POUND MASS*INCH^2 |

While the present disclosure may be adaptable to various modifications and alternative forms, specific embodiments have been shown by way of example and described herein. However, it should be understood that the present disclosure is not intended to be limited to the particular forms disclosed. Rather, it is to cover all modifications, equivalents, and alternatives falling within the spirit and scope of the disclosure as defined by the appended claims. For instance, although the disclosed apparatus has been illustrated and described mostly for the application in which paper towel are dispensed and held, the disclosed apparatus may accommodate any number of different rolled sheet materials such as toilet paper. The disclosed apparatus may be used to accommodate different orientations of components, sizes of components, or materials according to needs. Moreover, the different aspects of the disclosed methods and apparatuses may be utilized in various combinations and/or independently. Thus the invention is not limited to only those combinations shown herein, but rather may include other combinations.

What is claimed is:

1. An apparatus for holding and dispensing sheet material from a roll, comprising:

a core element configured to support said roll, comprising:

a rod;

a pair of end bells coupled to said rod and arranged in spaced relation;

a plurality of spring members coupled to said pair of end bells and extending in arcuate conformation along at least a portion of said rod;

a frame configured to support said core element, comprising:

a base;

a pair of opposing, generally parallel side members coupled to said base, each of said side members having a front edge and a facing side;

opposing grooves defined within said facing sides and contiguous with said front edges, said opposing grooves configured to cooperatively receive respective ends of said rod;

wherein each said groove defines a wedge having an angle of about 30 degrees, said wedge configured to pinchingly engage said rod to increase a friction force between said rod and said groove upon rotation of said rod; and wherein each said groove defines an angle of about 45 degrees with respect to said front edge; and wherein said core element has a moment of inertia complementing said friction force to retard rotation of said roll and to facilitate tearing of said sheet material from said roll.

2. The apparatus of claim 1, wherein said sheet material comprises paper towels.

3. The apparatus of claim 1, wherein said sheet material comprises toilet paper.

4. The apparatus of claim 1, wherein said end bells comprise one or more segments.

5. The apparatus of claim 4, wherein said plurality of spring members are secured between said segments.

6. The apparatus of claim 1, wherein at least a portion of an outer surface of said rod comprises a material having a gripping coefficient of friction greater than that of a material comprising the bulk of said rod.

7. The apparatus of claim 1, wherein said rod comprises metal.

8. The apparatus of claim 1, wherein said rod comprises plastic.

9. The apparatus of claim 1, wherein said rod comprises wood.

10. The apparatus of claim 1, wherein said rod is hollow.

11. The apparatus of claim 1, wherein said rod is heavier than said end bells.

12. The apparatus of claim 1, wherein the weight of said rod is concentrated at an outer radius of said rod.

* * * * *